United States Patent [19]

Porritt et al.

[11] Patent Number: 5,004,055

[45] Date of Patent: Apr. 2, 1991

[54] VIBRATORY CORE DRILL APPARATUS FOR THE RECOVERY OF SOIL OR SEDIMENT CORE SAMPLES

[75] Inventors: John Porritt, Picton; Hugh Scott, Wellington, both of Canada

[73] Assignee: Meta-Probe Inc., Picton, Canada

[21] Appl. No.: 338,716

[22] Filed: Apr. 14, 1989

[51] Int. Cl.[5] ..... E21B 7/24; E21B 25/00

[52] U.S. Cl. ..... 175/20; 175/55; 175/122; 175/170; 175/203; 175/77.5; 175/85

[58] Field of Search ..... 175/20, 55, 122, 135, 175/170, 202, 203, 244; 166/77.5, 85; 74/61, 571 R; 173/49

[56] References Cited

U.S. PATENT DOCUMENTS

| | | | |
|---|---|---|---|
| 2,848,196 | 8/1958 | Simmons | 175/122 |
| 2,914,305 | 11/1959 | Wink | 175/170 |
| 3,106,258 | 10/1963 | Muller | 175/55 |
| 3,402,621 | 9/1968 | Johnson et al. | 74/571 |
| 3,696,873 | 10/1972 | Anderson | 175/20 |
| 3,714,996 | 2/1973 | Dane, Jr. | 175/55 |
| 3,910,358 | 10/1975 | Martinek | 175/122 |
| 4,232,752 | 11/1980 | Hank et al. | 175/135 |
| 4,553,443 | 11/1985 | Rossfelder et al. | 175/55 |

FOREIGN PATENT DOCUMENTS 1163985 3/1984 Canada .

OTHER PUBLICATIONS

"Equipment and Techniques for Offshore Survey and Site Investigations", P. G. Sly, Canadian Geotechnical Journal, vol. 18, No. 2-1981, pp. 230-249.

"Evaluation of Equipment and Processes to Sample Offshort Placer Deposits from Small Fishing Vessels", Nordco Limited, Dec. 1986, pp. 36-87.

*Primary Examiner*—Bruce M. Kisliuk

*Attorney, Agent, or Firm*—Barrigar & Oyen

[57] ABSTRACT

A vibratory core drill apparatus for the recovery of soil or sediment core samples. The samples are collected within a rapidly vibrating sample tube which is driven into the ground by the apparatus. The apparatus comprises a drill stand, vibratory drive for imparting a vibratory motion to the sample tubes, coupling for coupling the sample tubes to the vibratory drive, support for supporting and restraining the coupling and vibratory drive, a carriage assembly for mounting the support to the drill stand in sliding up and down fashion, and carriage drive for lifting or lowering the carriage assembly. The invention permits the rapid recovery of representative soil or sediment samples at depths of up to 20 meters without the periodic disassembly of the invention during the drilling operation.

13 Claims, 6 Drawing Sheets

VIBRATORY CORE DRILL APPARATUS FOR THE RECOVERY OF SOIL OR SEDIMENT CORE SAMPLES

BACKGROUND OF THE INVENTION

This invention relates to a vibratory core drill apparatus for applying force to a sampling tube for the recovery of soil and sediment samples.

Recent trends in environment monitoring and pollution control have called for core sampling mechanisms which can deliver large diameter uncontaminated sediment and soil land fill profile cores. The fields of agriculture, engineering and mineral exploration also require large diameter undisturbed soil and sediment profile cores for structure and chemical analysis. Representative soil or sediment samples are often required at depths of up to twenty meters of overburden comprising sediments 25–80% solids.

The use of high frequency vibratory core sampling techniques facilitates the collection of sediment cores with minimal disruption of the circumference layer and without serious compaction or dewatering of the sample. Piston or gravity drive sampling systems including split spoons or shelby tubes often fail to deliver undisrupted and representative sediment or soil samples. Wink discloses a vibratory drill apparatus in Canadian Patent No. 1,163,985, but this apparatus suffers from many drawbacks. The Wink drill is hand held and underpowered, therefore the drill has a very limited penetration depth and is awkward to use. The Wink drill vibrates while it is in operation and, being hand held, the vibration of the Wink drill results in trauma to the arms of the operator. Furthermore, the Wink drill yields soil and sediment samples which are not truly representative due to the fact that the operator cannot apply a uniform downward force onto the drill. This ununiform downward force results in bullnosing or collection of an unrepresentative sample due to temporary blockage of the core tube by stiffer material in the sedimentary sequence.

The Wink drill does not permit the coupling and uncoupling of sampling tubes without first disconnecting the vibrator from a flexible power shaft or hydraulic line. This inability makes the operation of such vibratory drill slow, tedious and awkward. Furthermore, this drawback renders the use of a drill stand for mounting and steadying the vibratory drill, as well as a drive means for driving the sampling tube down into the ground, impractical.

Yet another problem with the prior art rested in the vibrators themselves. The amplitude of the vibrations produced by the said vibrators were not adjustable, furthermore, the frequency of vibration produced was difficult to regulate. Said prior art therefore, could not adjust the nature of the vibrations produced by their vibrators to match the soil or sediment conditions. As a result, said prior art yielded lower quality, less representative, soil or sediment samples.

U.S. Pat. Nos. 3,301,336 and 3,352,160, both to Mount disclose vibratory core sampling apparatus suffering many of the above mentioned drawbacks.

SUMMARY OF THE INVENTION

The present invention discloses a vibratory core drill apparatus for obtaining soil or sediment samples comprising a drill stand, a carriage assembly mounted within the drill stand in a vertically sliding fashion, carriage drive means for driving the carriage assembly up and down, vibratory drive means for applying a vertical vibratory force to the sampling tube, coupling means for coupling and decoupling the sampling tubes to the vibratory drive means without rotation of the vibratory drive means, and support means for supporting and restraining the coupling means and vibratory drive means within the carriage assembly.

The coupling means comprises a fixed member which is rigidly mounted to the vibratory drive means and a revolving member which is rotatably mounted to the fixed member. The revolving member is able to rotate freely in either the clockwise or counter-clockwise direction and is capable of coupling to the sampling tubes.

The vibratory drive means may comprise a pair of eccentric cams mounted to a drive shaft at a variable angle to each other, both being contained within a housing. Such vibratory drive means may be caused to vibrate by the rotation of the drive shaft, and the magnitude of the vibrations may be controlled by varying the angle between the cams. The said drive shaft may be rapidly rotated by a high speed hydraulic motor.

The support means may comprise an annular member having two side arms pivotally connected to the carriage assembly, the coupling means resting within the hollow of the annular member.

The carriage drive means may comprise a hydraulic drive motor connected to a shaft, wherein the rotation of the shaft lowers or raises the vibratory means and coupling means by means of a pair of chains attached to the vibratory means or coupling means. The carriage drive means is adapted to exert a uniform downward force onto the sampling tubes.

The apparatus may further comprise a hydraulic power means providing hydraulic power for the operation of both the carriage drive means and the vibratory drive means, wherein the hydraulic power means comprises a hydraulic pump for pumping hydraulic fluid, a motor for driving the hydraulic pump, a reservoir for storing hydraulic fluid, and a control module all contained as a separate unit capable of being disassembled for easy transportation.

The apparatus herein described is much easier to operate and suffers few of the drawbacks of the prior art. The present invention avoids these drawbacks whilst maintaining the ability to collect large diameter undisturbed and uncontaminated sediment and soil/land fill profile cores.

DESCRIPTION OF THE PREFERRED EMBODIMENT

A better understanding of the present invention may be had by reference to the following description of the presently preferred embodiment, taken in connection with the drawings. Vibratory core drill apparatus for obtaining soil and sediment samples in accordance with the present invention, is illustrated in FIGS. 1 through 7.

Figure 1:
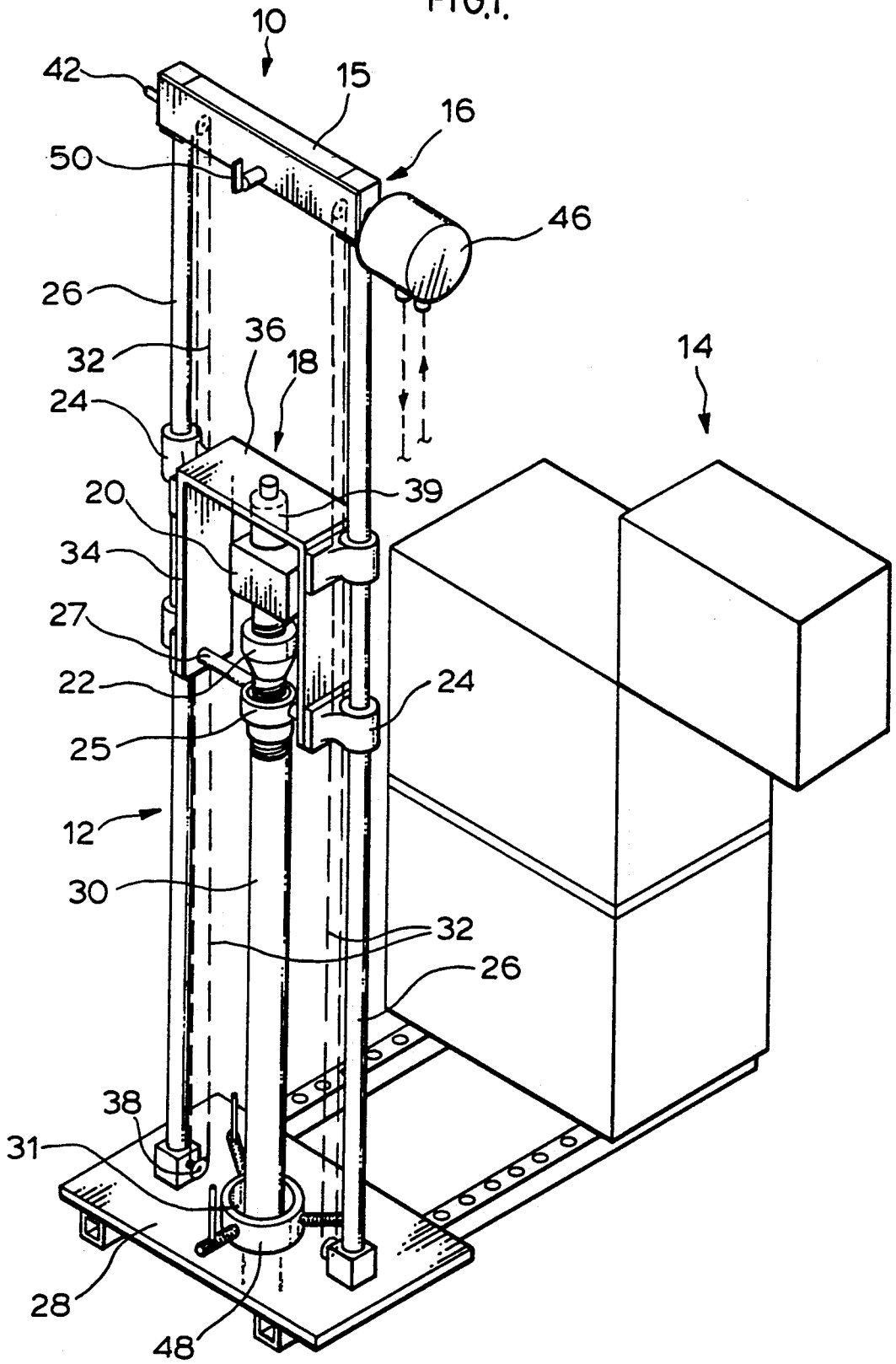
FIG. 1 is a perspective view of the apparatus of the present invention.
Figure 2:
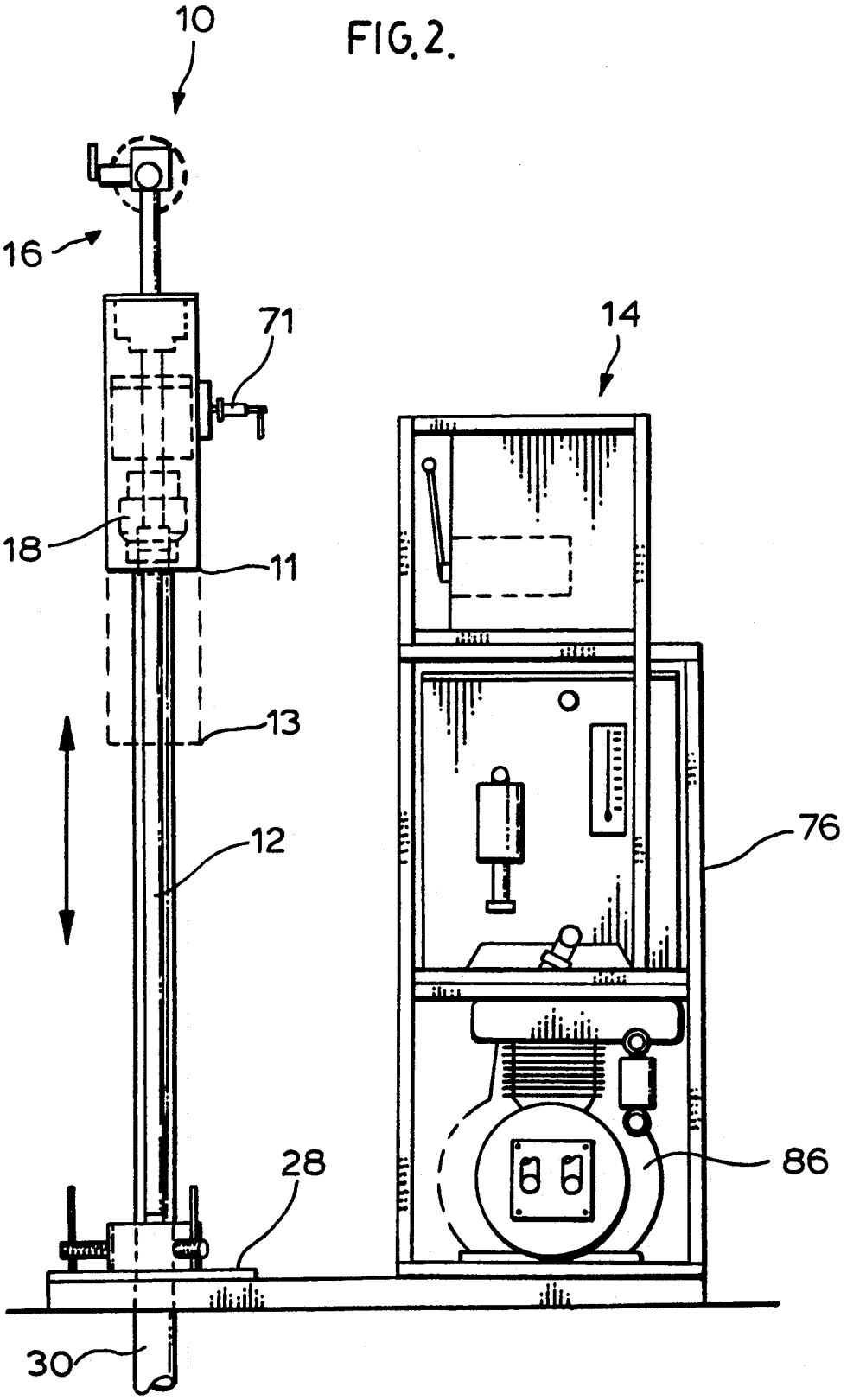
FIG. 2 is a side view of said apparatus.
Figure 3:
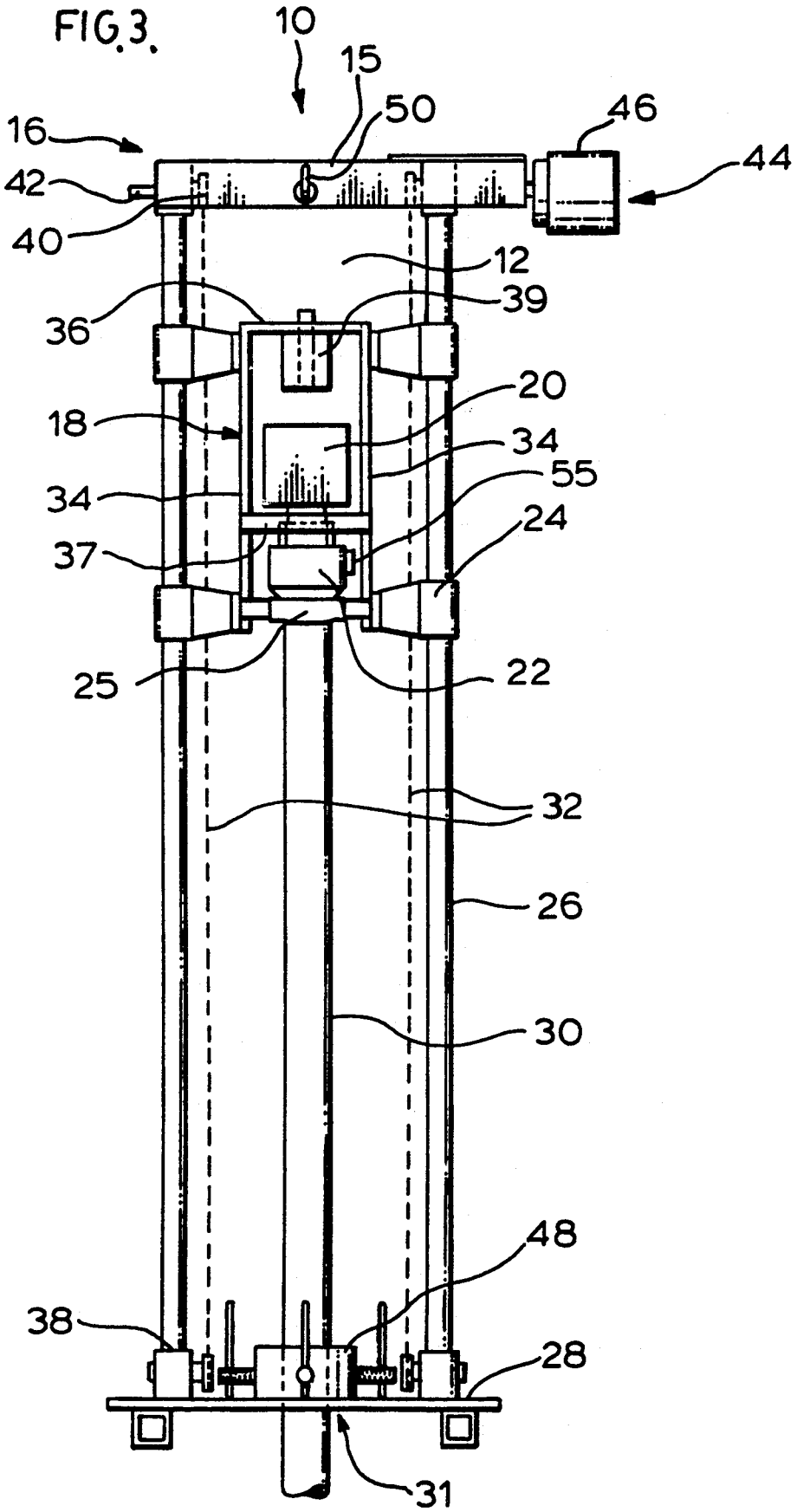
FIG. 3 is a front elevational view of a portion of the apparatus of FIG. 1.

Referring to FIGS. 1, 2 and 3, the apparatus shown therein comprises a vibratory core drill shown generally as 10 and a hydraulic power means shown generally as 14. The vibratory core drill comprises a drill stand shown generally as 12, a carriage assembly 18 mounted within drill stand 12, vibratory drive means 20 and coupling means 22 mounted within the carriage assembly 18, carriage drive means shown generally as 16, and restraining means 48.

Drill stand 12 comprises a pair of vertical side members 26, base plate 28, and head frame 15. Base plate 28 has an opening 31 to permit the travel of sample tube 30. Immediately above opening 31 and mounted to base plate 28 is rod restraining means 48 which serves to support and steady sample tube 30 within drill stand 12, during operation of the drill.

Carriage assembly 18 comprises a frame having side members 34, top member 36, and cross bar 37. Support means 25 is pivotally mounted between the lower inside surfaces of side members 34. Vibratory drive means 20 is mounted atop coupling means 22, adaptor 23 is mounted beneath coupling means 22, and coupling means 22 and adaptor 23 are in turn mounted within support means 25. Snubber 39 is mounted to top frame member 36 and cushions the vibratory drive means 20 from contact with top member 36. Sliders 24 are mounted at one end to the outside faces of side members 34 adjacent the corners of carriage assembly 18. At their other ends, sliders 24 are slidingly mounted to side members 26 of drill stand 12 so as to permit the carriage assembly to slide up and down from a position of full retraction 11 to a position of full extension 13, as shown in FIG. 2.

Carriage drive means 44 comprises shaft 42 mounted within head frame 15 of drill stand 12, hydraulic motor 46 connected to drive shaft 42 and mounted to head frame 15, upper sprockets 40 mounted to shaft 42, lower sprockets 38 mounted near base plate 28, and roller chains 32 which travel between upper sprockets 40 and lower sprockets 38. Roller chains 32 are coupled to the carriage assembly 18 by attachment to sliders 24. Operation of the hydraulic motor 46 causes the spinning of shaft 42 which in turn raises or lowers carriage assembly 18.

Figure 5:
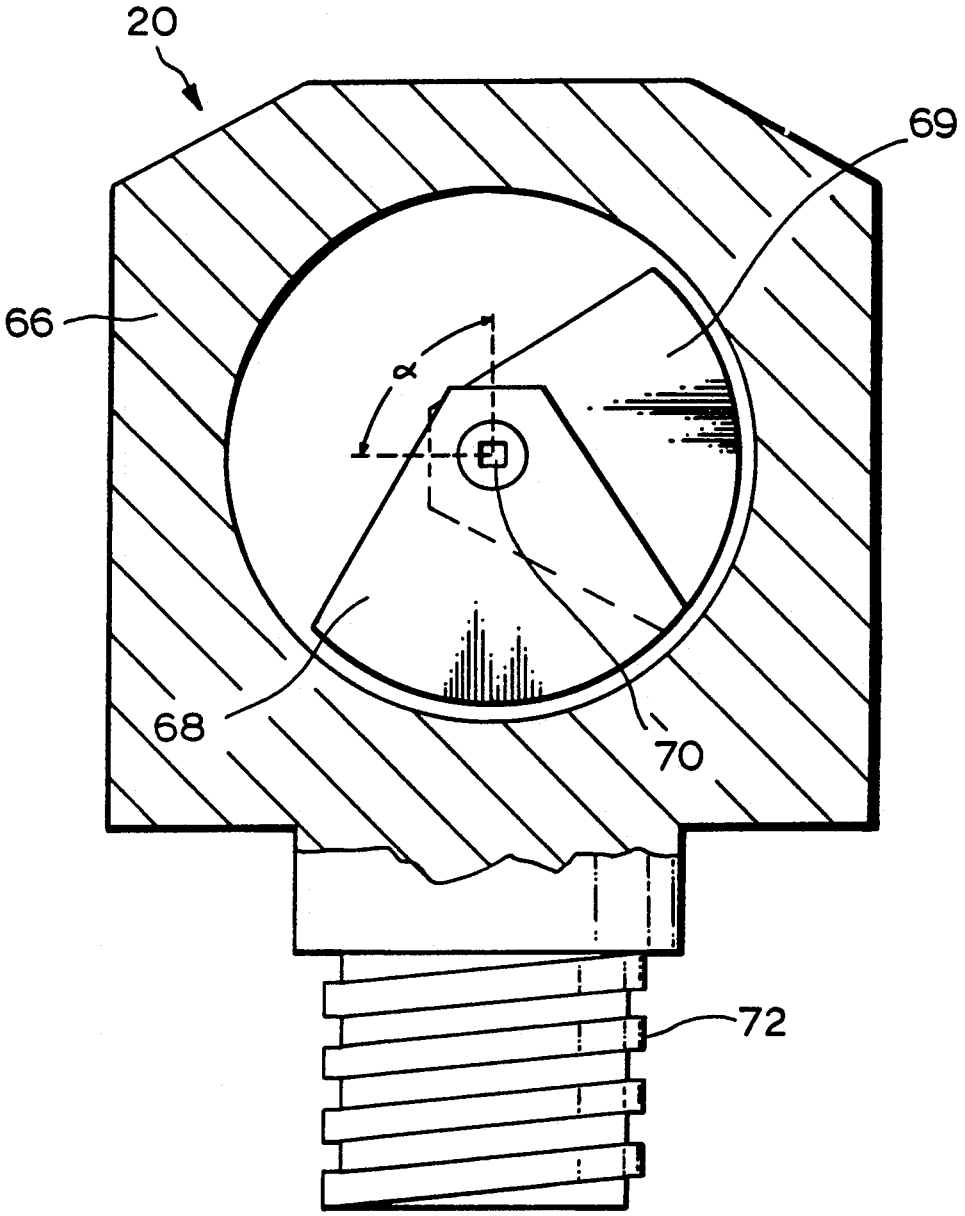
FIG. 5 is a cross-sectional view through the vibratory drive means of the apparatus in FIGS. 1 and 2.

With primary reference to FIGS. 2 and 5, vibratory drive means 20 comprises eccentric cams 68 and 69 which are mounted onto shaft 70 within housing 66. Hydraulic motor 71 is connected to shaft 70. Eccentric cams 68 and 69 are positioned on shaft 70 at a variable angle alpha relative to each other. Eccentric cam 69 is thicker and heavier than eccentric cam 68. Threaded lower portion 72 serves to attach vibratory drive means 20 to coupling means 22. The operation of hydraulic motor 71 causes the spinning of shaft 70 and in turn causes vibration due to the revolving of the eccentric cams. The amplitude of the vibration can be varied by changing the variable cam angle alpha. When alpha equals 180° the eccentric cams are counteropposed and, therefore, the spinning of shaft 70 result in minimal amplitude of vibration. Maximal amplitude of vibration results from the lowering of the variable cam angle alpha to 0°.

Figure 4:
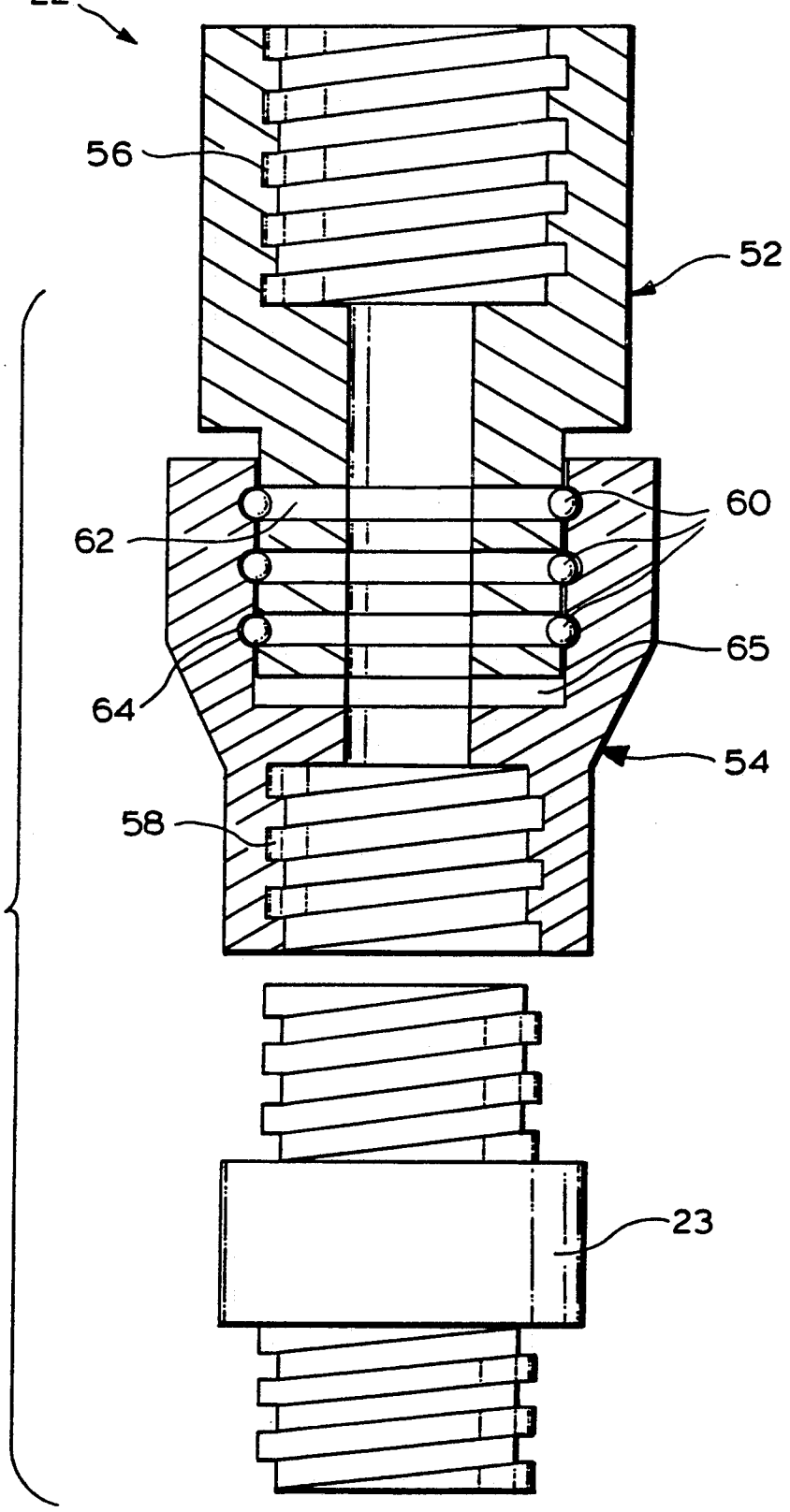
FIG. 4 is a cross-sectional view through the coupling means in the apparatus of FIGS. 1 and 2.

Referring now primarily to FIG. 4, coupling means 22 comprises fixed member 52 and rotatable member 54 mounted below fixed member 52. Fixed member 52 is attached to the threaded lower portion 72 of vibratory means 20 shown in FIG. 5 by a threaded upper portion 56. The upper portion of rotatable member 54 fits over the lower portion of fixed member 52. A plurality of bearing races 62 are cut along the periphery of the lower portion of fixed member 52 and bearing races 64 are cut along the inside surface of the upper portion of rotatable member 54. Ball bearings 60 ride within the bearing races 62 and 64 between fixed member 52 and rotatable member 54. Ring seal 65 separates the bottom most portion of fixed member 52 from rotatable member 54. Plug 55 shown in FIG. 3 serves to seal an opening (not shown) extending perpendicularly through one wall of rotatable member 54 through which oil or grease may be injected for lubrication of ball bearings 60. Rotatable member 54 has a female threaded lower end having threads 58 which permit male to male adaptor 23 to be screwed into rotatable member 54. Rotatable member 54 is then connectable to sampling tubes by connectioning male adaptor 23 to sampling tubes and then rotating rotatable member 54. Because rotatable member 54 can rotate freely relative to fixed member 52, sampling tubes may be connected to the coupling means without having to rotate fixed member 52.

Figure 6A:
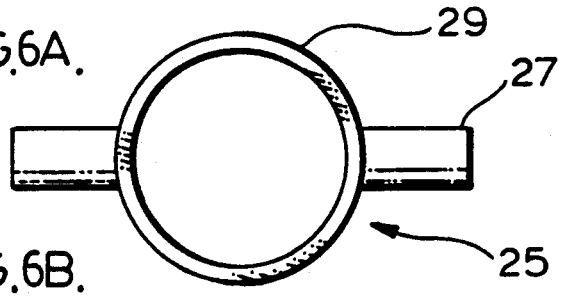
FIG. 6*a* is top view of the support means.
Figure 6B:
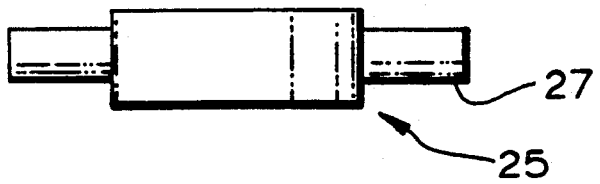
FIG. 6*b* is a side view of said support means.

Referring to FIGS. 1, 6*a* and 6*b*, support means 25 comprises an annular portion 29 and side arms 27. Side arms 27 are pivotally mounted directly to the side portions 34 of carriage assembly 18. The inside diameter of annular or ring portion 29 is slightly greater than the outside diameter of the lower portion of rotatable member 54 enabling the lower portion of rotatable member 54 to sit within support means 25. Male adaptor 23 fits within the hollow of annular portion 29.

Support means 25 provides support to coupling means 22 when carriage assembly 18 is being raised. Support means 25 also helps restrain sample tube 30. Furthermore, when in place, support means 25 allows vibratory drive means 20 and coupling means 22 to be angularly displaced relative to carriage assembly 18 by pivoting about the longitudinal axis of side arms 27. This angular displacement of vibratory drive means 20 and coupling means 22 provides for easier attachment of sampling tubes 30.

Figure 7:
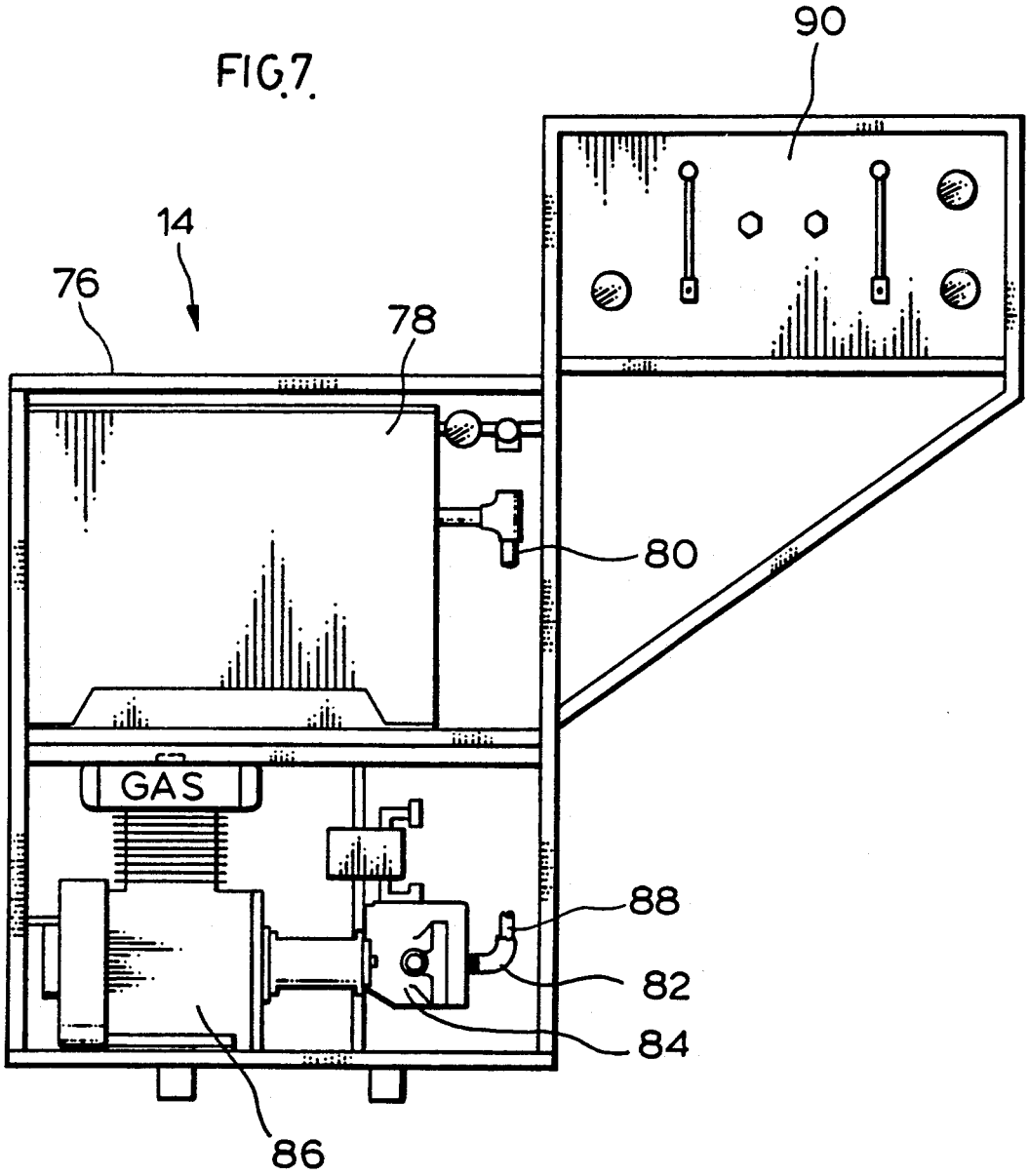
FIG. 7 is a front elevation in section of a portion of the apparatus of FIG. 1.

Referring to FIG. 7, hydraulic power means 14 comprises reservoir 78 for storing hydraulic fluid, hydraulic pump 84 for pumping hydraulic fluid to a high pressure, a prime mover such as engine 86 for operating the hydraulic pump 84, and control module 90 for regulating the hydraulic pressure supplied to hydraulic motor 71 and hydraulic motor 46. Engine 86 may be either a gasoline or diesel engine. Frame 76 mounts engine 86 and hydraulic pump 84 beneath reservoir 78; control module 90 is also mounted to frame 76. Flexible hose 80 transports hydraulic fluid to inlet 82 while outlet 88 permits pressurized hydraulic fluid to be transported via flexible hoses to control module 90. Flexible hoses then carry the pressurized hydraulic fluid from control module 90 to both hydraulic motor 46 and hydraulic motor 71. Other flexible hoses carry depressurized hydraulic fluid back to reservoir 78. Frame 76 may be diassembled for easy transportation into three separate units containing reservoir 78, engine 86 and hydraulic pump 84, and control module 90 respectively.

The operation of the vibratory core drill apparatus of the present invention will now be described. Prime mover 86 is activated, and hydraulic pump 84 pressurizes a quantity of hydraulic fluid which makes its way to hydraulic motors 71 and 46. Control module 90 modulates the flow of pressurized hydraulic fluid to hydraulic motors 71 and 46. The first sampling tube 30 is then coupled to coupling means 22 while carriage assembly 18 is in its fully retracted position and fitted through rod restraining means 48. Vibratory drive 20 is then made to vibrate at approximately 200 hz by the flow of hydraulic fluid through hydraulic motor 71. Carriage drive means 44 is then activated to lower carriage assembly 18 with sufficient force so as to cause the rapidly vibrating sample tube 30 to penetrate the soil, snubber 39 restraining the upward movement of vibratory drive means 20. Rod restraining means 48 and support means 25 guide and steady sample tube 30 as it penetrates the soil. For deeper penetration, sample tube 30 is disconnected from male adaptor 23 extending from coupling means 22 by rotation of rotatable member 54, and the carriage assembly 18 is fully retracted. Then, another sample tube is screwed onto male adapter 23, after pivoting coupling means 22 towards the operator if desired, and the new sample tube is screwed onto the sample tube in the ground by rotation of rotatable member 54. The carriage assembly 18 is then forcibly lowered by operation of carriage drive means 44, so as to drive the additional sample tube section into the soil. This procedure can be repeated several times to obtain penetration depths of up to twenty meters. The samples can be retrieved by reversing the procedure. Very accurate and representative soil core samples may be obtained by regulating the amplitude of vibration and the rate of sample tube penetration.

Many changes could be made in the above disclosed apparatus without departing from the scope thereof. It is therefore intended that all matter contained in the above description, or shown in the accompanying drawings, shall be interpreted as being illustrative only and not limiting.

I claim:

1. A vibratory core drill apparatus for applying force to a sampling tube, comprising (a) a drill stand;

(b) a carriage assembly mounted to the drill stand in a vertically sliding fashion;

(c) carriage drive means for driving the carriage assembly up and down by the application of vertical force thereto;

(d) vibratory drive means contained within the carriage assembly for applying a vertical vibratory force to the sampling tube;

(e) coupling means for coupling and decoupling the sampling tube to the vibratory drive means without rotation of the vibratory drive means; and (f) support means mounted within the carriage assembly for supporting the coupling means within the carriage assembly wherein the support means comprises a yoke having an annular portion sized to receive the coupling means and two axial side arms pivotally mounted to the carriage assembly so as to allow the support means to pivot about the longitudinal axis of the side arms.

2. An apparatus as defined in claim 1, wherein the coupling means comprises a fixed member adapted to be rigidly mounted to the underside of the vibratory drive means and a rotatable member rotatably mounted beneath the fixed member, the rotatable member being able to rotate freely in either the clockwise or counterclockwise direction, the rotatable member having a lower portion for the coupling of sampling tubes.

3. An apparatus as defined in claim 1, wherein the vibratory drive means comprises a pair of eccentric cams mounted to a drive shaft at a variable angle to each other, the eccentric cams together with the drive shaft being contained within a housing, the drive shaft together with the eccentric cams being able to rotate in one direction, the axis of rotation being horizontal, wherein the rotation of the cams causes the vibratory drive means to vibrate in the vertical direction, the variable angle between the cams being adjustable so as to control the magnitude of the vibrations.

4. An apparatus as defined in claim 3, wherein the vibratory drive means vibrates at approximately 200 Hz.

5. An apparatus as defined in claim 1, wherein the carriage drive means is capable of applying a uniform downward force to the carriage assembly.

6. An apparatus as defined in claim 1, wherein the drill stand comprises a base plate and a top portion separated by two vertical side members.

7. An apparatus as defined in claim 6, wherein the carriage drive means comprises two loops of chain each running parallel to the vertical side members of the drill stand, and an upper and a lower pair of sprockets attaching each loop of chain to its respective vertical side member, wherein the upper pair of sprockets is attached at opposite ends of a shaft which is rotatably mounted to the top member of the drill stand, a hydraulic drive motor connected to both the shaft and the top member of the drill stand, the hydraulic drive motor being capable of turning the shaft, and wherein each loop of chain is attached to the carriage assembly.

8. An apparatus as defined in claim 7, wherein the vibratory drive means is hydraulically powered from the same hydraulic power source that powers the carriage drive means.

9. An apparatus as defined in claim 8, further comprising a hydraulic power means for providing hydraulic power for the operation of the carriage drive means and the vibratory drive means, the hydraulic drive means being self contained, wherein the hydraulic power is transferred to the vibratory drive means and the carriage drive means by high pressure hydraulic hoses.

10. An apparatus as defined in claim 9, wherein the hydraulic power means comprises a reservoir for the storing of hydraulic fluid, a hydraulic pump for pumping the hydraulic fluid to a high pressure, a prime mover for driving the hydraulic pump, the hydraulic pump and prime mover being mounted within a frame, the reservoir being mounted atop said frame; a control module for the control of hydraulic power being supplied from the hydraulic pump to the drive means and vibratory drive means, said control module being mounted to the frame, said frame being capable of being disassembled for ease of transportation.

11. An apparatus as defined in claim 6, wherein the carriage assembly comprises a top portion, two side portions, and sliders connected to the side members of the carriage assembly for mounting the carriage assembly to the vertical side members of the drill stand in a sliding fashion.

12. An apparatus as defined in claim 6, further comprising restraining means for steadying, supporting and guiding the travel of a sample tube as it travels through an opening in the base plate wherein said restraining means is mounted to the top surface of the base plate.

13. A vibratory core drill apparatus for applying force to a sampling tube, comprising a drill stand having a base plate and a top portion separated by two vertical side members; a carriage assembly mounted to the drill stand in a vertically sliding fashion; carriage drive means for driving the carriage assembly up and down by the application of a uniform force thereto during operation; vibratory drive means contained within the carriage assembly for applying a vertical vibratory force to the sampling tube; coupling means for coupling and decoupling sampling tubes to the vibratory drive means having a fixed member rigidly mountable to the vibratory drive means and a rotatable member rotatably mounted beneath the fixed member, said rotatable member being able to couple to sampling tubes by rotating freely, support means mounted within the carriage assembly for supporting the coupling means within the carriage assembly, wherein said support means comprises a yoke having an annular portion sized to receive the coupling means and two axial side arms pivotally mounted to the carriage assembly so as to allow the support means to pivot about the longitudinal axis of the side arms.

* * * * *